US009092000B2

(12) United States Patent
Morishita

(10) Patent No.: US 9,092,000 B2
(45) Date of Patent: Jul. 28, 2015

(54) CLEANING UNIT, IMAGE FORMING APPARATUS INCLUDING THE SAME, AND SHUTTER PROVIDED IN CLEANING UNIT

(71) Applicant: KYOCERA DOCUMENT SOLUTIONS INC., Osaka (JP)

(72) Inventor: Hiroki Morishita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/250,473

(22) Filed: Apr. 11, 2014

(65) Prior Publication Data

US 2014/0321896 A1 Oct. 30, 2014

(30) Foreign Application Priority Data

Apr. 26, 2013 (JP) ..... 2013-094140

(51) Int. Cl.
*G03G 21/00* (2006.01)
*G03G 21/12* (2006.01)
*G03G 21/10* (2006.01)

(52) U.S. Cl.
CPC ..... *G03G 21/12* (2013.01); *G03G 21/105* (2013.01); *G03G 2215/0692* (2013.01)

(58) Field of Classification Search
CPC .... G03G 21/105; G03G 21/12; G03G 15/161
USPC ..... 399/358
See application file for complete search history.

(56) References Cited

U.S. PATENT DOCUMENTS

2011/0277986 A1* 11/2011 Purkis ..... 166/181

FOREIGN PATENT DOCUMENTS

JP 2010-256741 A 11/2010

OTHER PUBLICATIONS

Machine translation of JP 2010 256741 A, publication date: Nov. 11, 2010.*

* cited by examiner

*Primary Examiner* — Walter L Lindsay, Jr.
*Assistant Examiner* — Frederick Wenderoth
(74) *Attorney, Agent, or Firm* — Studebaker & Brackett PC

(57) ABSTRACT

A cleaning unit includes a cleaning member eliminating a waste toner from an image carrier, a waste toner conveying body conveying the waste toner in a conveying channel to a waste toner case, a shutter having an ejecting port and a shutter moving mechanism moving the shutter between an opening position and a closing position. Via the ejecting port, the conveying channel and waste toner case are communicated. The shutter contacts with/separates from a seal preventing a leak of the waste toner from the ejecting port. When the shutter is rotated in one direction and moved to the opening position to make an outer end face of the shutter contact with the seal, the ejecting port is opened. When the shutter is rotated in another direction and moved to the closing position to make the outer end face of the shutter separate from the seal, the ejecting port is closed.

2 Claims, 15 Drawing Sheets

CLEANING UNIT, IMAGE FORMING APPARATUS INCLUDING THE SAME, AND SHUTTER PROVIDED IN CLEANING UNIT

INCORPORATION BY REFERENCE

This application is based on and claims the benefit of priority from Japanese Patent application No. 2013-094140 filed on Apr. 26, 2013, the entire contents of which are incorporated herein by reference.

BACKGROUND

The present disclosure relates to a cleaning unit, an image forming apparatus including the same and a shutter provided in the cleaning unit, which are preferably applied as a copying machine, a printer or the like.

There is an image forming apparatus provided with a cleaning unit eliminating a waste toner from an image forming face of an image carrier after an image is formed.

For example, a drum unit including a cleaning unit is provided with a rubbing roller and a cleaning blade scraping a waste toner from an image forming face of a photosensitive drum, a screw conveying the waste toner dropped in a casing, and a cup-like formed shutter opening/closing the casing. The waste toner is ejected from an ejecting port formed in the shutter to a toner conveying part and collected in a collecting case. When the drum unit (the cleaning unit) is detached from an apparatus main body, the shutter is turned around the axis to close the ejecting port.

Incidentally, in the above-mentioned cleaning unit, in a connecting portion of the ejecting port of the shutter and the toner conveying part, a seal is provided to prevent a leak of the waste toner. The seal is arranged in close contact with a circumference edge of the ejecting port or an outer end face (an outside face) of the shutter to prevent the leak of the waste toner.

However, when the cleaning unit is attached/detached in a direction orthogonal to an action direction of the close contact force of the outer end face of the shutter to the seal, this close contact force causes resistance to attaching/detaching work. This makes the attaching/detaching work difficult. In addition, a close contact condition of the outer end face of the shutter to the seal causes a friction force to prevent the turn of the shutter. Therefore, there is a problem that the ejecting port is inappropriately closed. This problem may be solved by weakening the close contact force between the shutter and seal. However, in order to prevent the leak of the waste toner, it is impossible to lightly weaken the close contact force.

In a case where the shutter is smoothly turned, since the close of the ejecting port advances by interlocking with the advance of the turn of the shutter, the close contact condition to the seal is released before the ejecting port is completely closed by the shutter. Therefore, there is a problem that the waste toner is leaked from the ejecting port when the cleaning unit is detached from the apparatus main body.

SUMMARY

A cleaning unit of one aspect of the present disclosure includes a cleaning member, a waste toner conveying body, a cylindrical shutter and a shutter moving mechanism. The cleaning member eliminates a waste toner from an image forming face of an image carrier forming a toner image. The waste toner conveying body conveys the waste toner in a conveying channel arranged in a casing supporting the cleaning member to a waste toner case. The shutter has an openable/closable ejecting port making the conveying channel and waste toner case communicate with each other. The shutter is arranged so as to be able to contact with/separate from a seal preventing a leak of the waste toner from the ejecting port. The shutter moving mechanism moves the shutter between an opening position and a closing position. When the shutter is rotated in one direction around an axis, and simultaneously, moved in an axial direction so as to make an outer end face of the shutter contact with the seal, the shutter is located at the opening position and the ejecting port is opened. When the shutter is rotated in another direction around the axis, and simultaneously, moved in the axial direction so as to make the outer end face of the shutter separate from the seal, the shutter is located at the closing position and the ejecting port is closed.

An image forming apparatus of one aspect of the present disclosure includes a cleaning unit. The cleaning unit includes a cleaning member, a waste toner conveying body, a cylindrical shutter and a shutter moving mechanism. The cleaning member eliminates a waste toner from an image forming face of an image carrier forming a toner image. The waste toner conveying body conveys the waste toner in a conveying channel arranged in a casing supporting the cleaning member to a waste toner case. The shutter has an openable/closable ejecting port making the conveying channel and waste toner case communicate with each other. The shutter is arranged so as to be able to contact with/separate from a seal preventing a leak of the waste toner from the ejecting port. The shutter moving mechanism moves the shutter between an opening position and a closing position. When the shutter is rotated in one direction around an axis, and simultaneously, moved in an axial direction so as to make an outer end face of the shutter contact with the seal, the shutter is located at the opening position and the ejecting port is opened. When the shutter is rotated in another direction around the axis, and simultaneously, moved in the axial direction so as to make the outer end face of the shutter separate from the seal, the shutter is located at the closing position and the ejecting port is closed.

A shutter of one aspect of the present disclosure is provided in a cleaning unit. The cleaning unit includes a cleaning member, a waste toner conveying body and a shutter moving mechanism. The cleaning member eliminates a waste toner from an image forming face of an image carrier forming a toner image. The waste toner conveying body conveys the waste toner in a conveying channel arranged in a casing supporting the cleaning member to a waste toner case. The shutter has an openable/closable ejecting port making the conveying channel and waste toner case communicate with each other. The shutter is formed in a cylindrical shape to contact with/separate from a seal preventing a leak of the waste toner from the ejecting port. The shutter is moved between an opening position and a closing position by the shutter moving mechanism. When the shutter is rotated in one direction around an axis, and simultaneously, moved in an axial direction so as to make an outer end face of the shutter contact with the seal, the shutter is located at the opening position and the ejecting port is opened. When the shutter is rotated in another direction around the axis, and simultaneously, moved in the axial direction so as to make the outer end face of the shutter separate from the seal, the shutter is located at the closing position and the ejecting port is closed.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference to the appended drawings, a color printer as an image forming apparatus including a cleaning unit according to an embodiment of the present disclosure will be described. It is noted that, in the following description, a front side of the color printer 1 is defined by an arrow Fr shown in the figures, for convenience.

Figure 1:
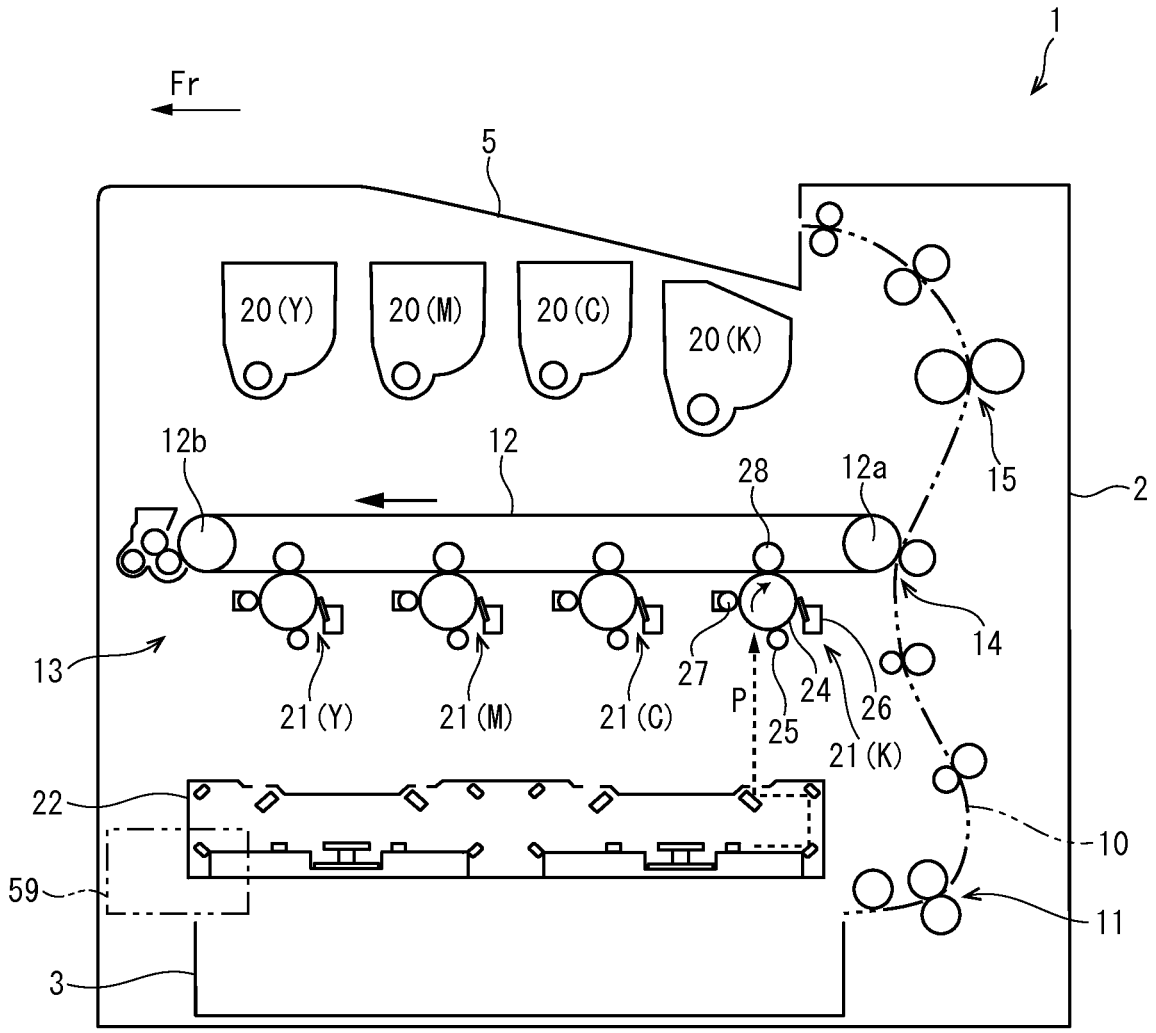
FIG. 1 is a sectional view schematically showing an internal structure of a color printer according to an embodiment of the present disclosure.
Figure 2:
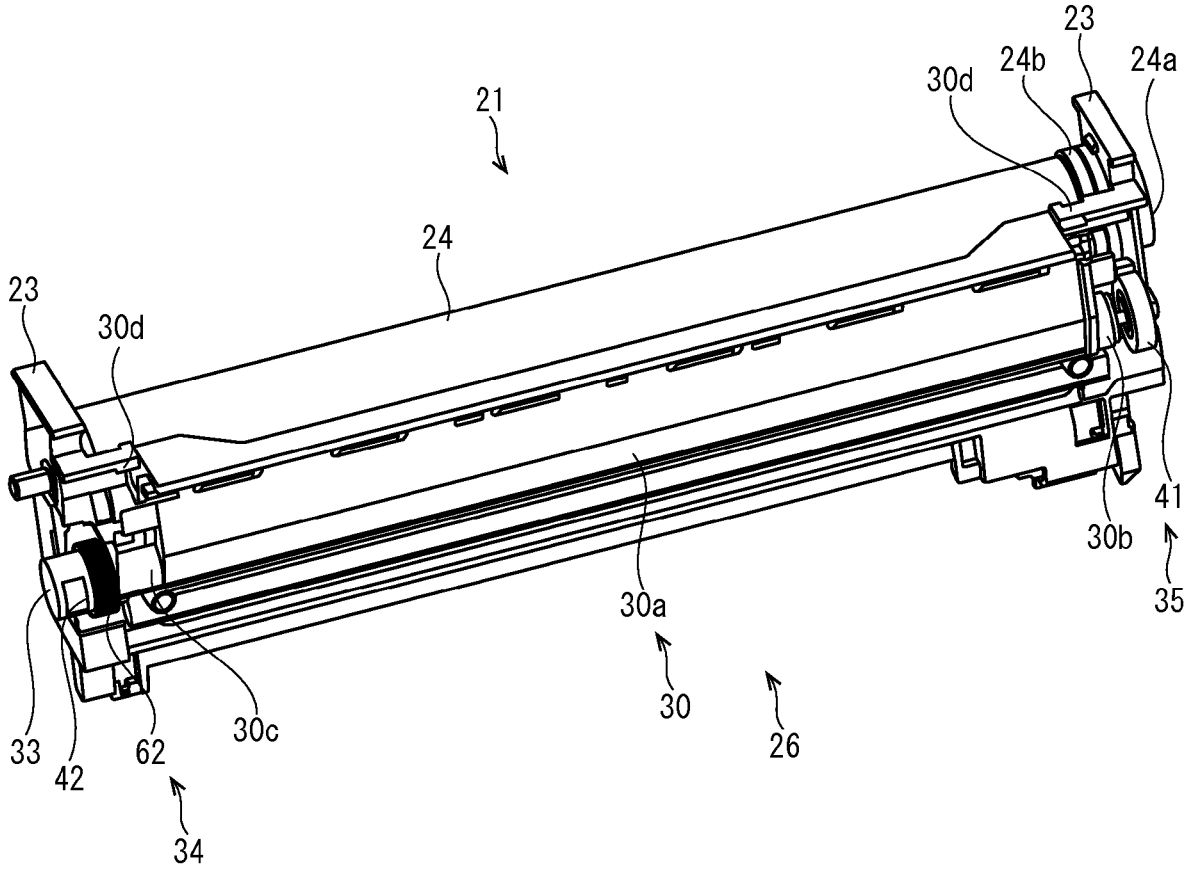
FIG. 2 is a perspective view of a drum unit of the color printer according to the embodiment of the present disclosure.
Figure 3:
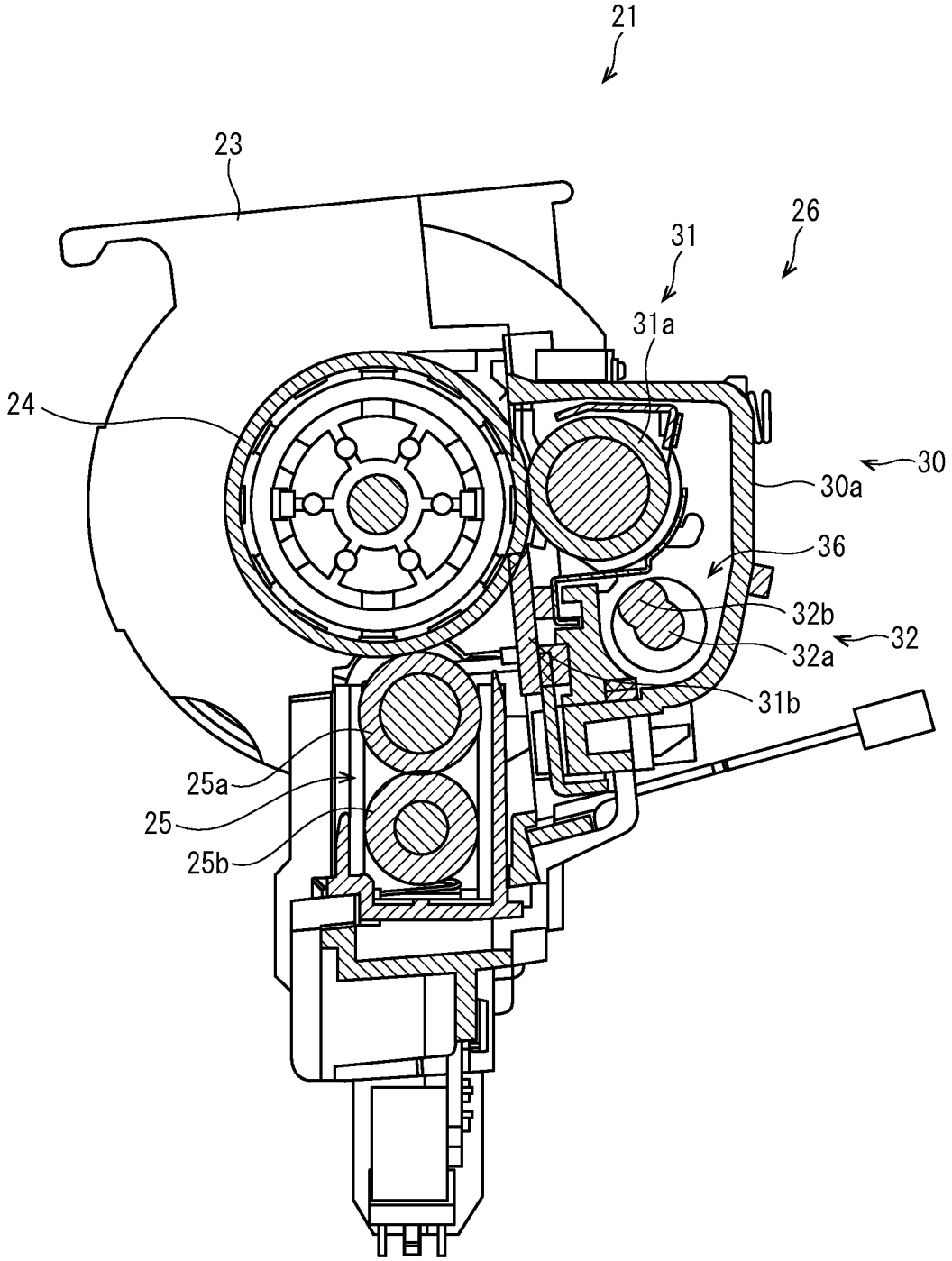
FIG. 3 is a sectional view of the drum unit of the color printer according to the embodiment of the present disclosure.

First, with reference to FIGS. 1 to 3, the entire structure of the color printer 1 will be descried. FIG. 1 is a sectional view schematically showing the inside structure of the color printer 1. FIG. 2 is a perspective view showing a drum unit 21. FIG. 3 is a sectional view showing the drum unit 21.

As shown in FIG. 1, the color printer 1 includes an apparatus main body 2 that constitutes main appearance, a sheet feeding cartridge 3 arranged in a lower part of the apparatus main body 2, a manual bypass tray (not shown) arranged in a front face of the apparatus main body 2, and an ejected sheet tray 5 arranged in an upper face of the apparatus main body 2.

In addition, the color printer 1 includes a sheet feeding part 11, an image forming part 13, a second transfer nip part 14 and a fixing device 15 inside the apparatus main body 2. The sheet feeding part 11 feeds a sheet stored in the sheet feeding cartridge 3 to a conveyance path 10. The image forming part 13 first-transfers a toner image onto an intermediate transfer belt 12. The second transfer nip part 14 second-transfers the first-transferred toner image onto the sheet. The fixing device 15 fixes the second-transferred toner image to the sheet.

The intermediate transfer belt 12 is arranged horizontally and wound around a driving roller 12*a* and a tension roller 12*b*. The intermediate transfer belt 12 is rotated in a predetermined direction (refer to an arrow shown in FIG. 1) by driving and rotating the driving roller 12*a* with a driving motor (not shown).

The image forming part 13 forms an image by replenishment toners (developers) of four colors (yellow, magenta, cyan, and black) contained in four toner containers 20. The image forming part 13 is provided with four drum units 21 respectively having photosensitive drums 24 as an image carrier, and exposure devices 22 irradiating the surface of the photosensitive drums 24 with laser light (refer to an arrow P shown in FIG. 1).

The four toner containers 20 are arranged at a lower side of the ejected sheet tray 5. The four toner containers 20 are attachably/detachably provided inside the apparatus main body 2 individually. The four drum units 21 are arranged at a lower side of the intermediate transfer belt 12 in parallel in forward and backward directions. Since four drum units 21 have the similar configuration to each other, in the following, one drum unit 21 will be described.

As shown in FIGS. 2 and 3, the drum unit 21 has the photosensitive drum 24, a charger 25, and a cleaning unit 26. The photosensitive drum 24 is rotatably supported via a drum bearing part 24*a* by a pair of supporting frames 23 arranged at both sides in an axial direction. The charger 25 electrically charges the surface (an image forming face) of the photosensitive drum 24 to given potential uniformly. The cleaning unit 26 eliminates the waste toner remained on the surface of the photosensitive drum 24. The charger 25, a development device 27, a first-transferring roller 28 and the cleaning unit 26 are arranged in order of first-transferring process around the photosensitive drum 24 (refer to FIG.

The photosensitive drum 24 has an amorphous silicon photosensitive layer around an outer circumference face of a drum blank tube made of electroconductive material, such as aluminum. The photosensitive drum 24 is formed so as to be extended in left and right directions. To one end (a right end in FIG. 2) of the photosensitive drum 24, a drum drive gear wheel 24*b* is pivotally supported. The drum drive gear wheel 24*b* is meshed with a drive gear 29 (refer to FIG. 12A and other figures) driven and rotated by a driving motor (not shown).

The charger 25 has a charging roller 25*a* coming into slidably contact with the photosensitive drum 24 and a rubbing roller 25*b* rubbing the surface of the charging roller 25*a*. Both ends in an axial direction of the charging roller 25*a* and rubbing roller 25*b* are supported by a lower part of the pair of supporting frames 23.

Image forming process by the color printer 1 will be described. When the power is supplied to the color printer 1, the color printer 1 initializes various parameters, such as temperature determination of the fixing device 15. In the color printer 1, when image data is inputted and a printing start is directed from a personal computer or the like connected with the color printer 1, image forming operation is carried out as follows.

Each exposure device 22 carries out exposure corresponding to the image data onto the surface of each photosensitive drum 24 electrically charged by each charger 25 to form an electrostatic latent image. Each development device 27 develops the electrostatic latent image to the toner image by each color toner supplied from each toner container 20.

The intermediate transferring belt 12 sequentially carries each color of the toner image first-transferred by each first-transferring roller 28 to which bias is applied. On the intermediate transferring belt 12, a full color toner image is formed. On the other hand, the sheet fed from the sheet feeding cartridge 3 (or the manual bypass tray) by the sheet feeding part 11 is conveyed to the second transfer nip part 14 in the conveyance path 10. The second transfer nip part 14 second-transfers the full color toner image onto the sheet by applied bias. This sheet is fixing-processed by the fixing device 15. After that, the sheet is ejected onto the ejected sheet tray 5. The toner (waste toner) remained on each photosensitive drum 24 is eliminated by the cleaning unit 26.

Figure 4:
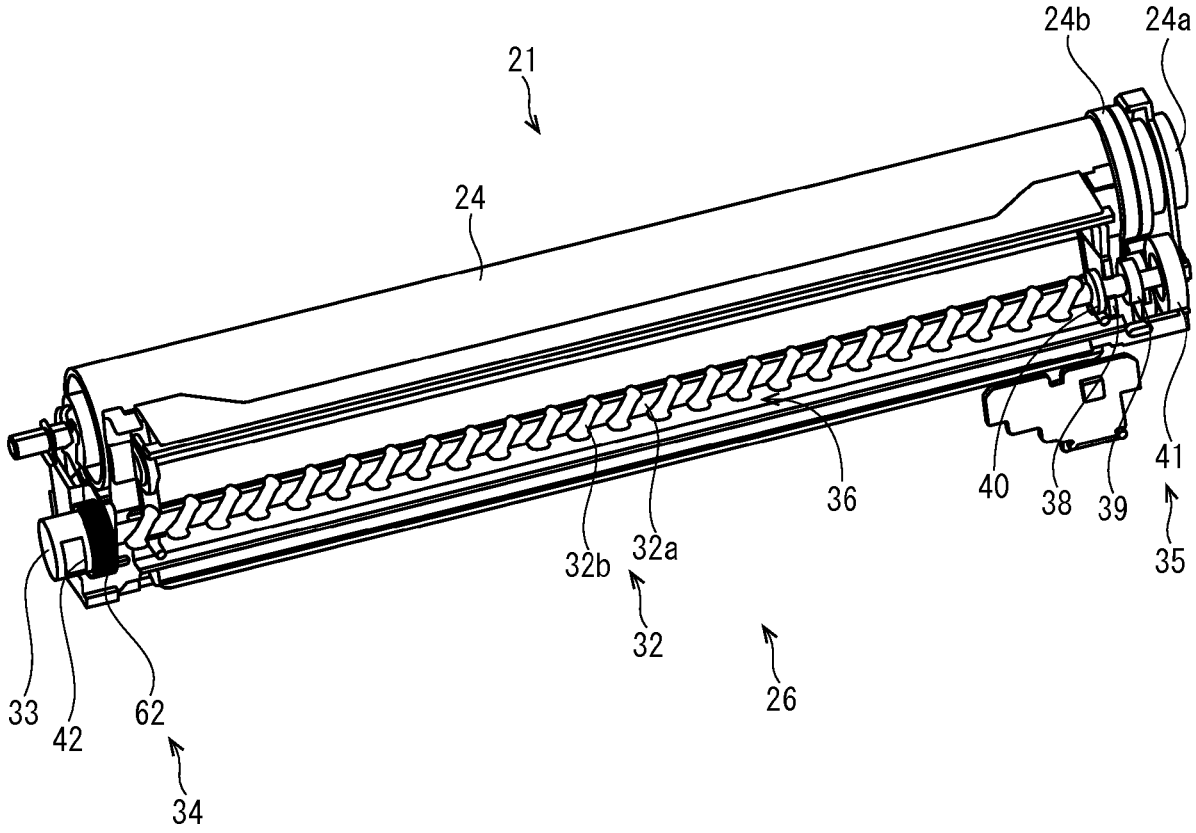
FIG. 4 is a perspective view of an internal structure of a cleaning unit according to the embodiment of the present disclosure.
Figure 5A:
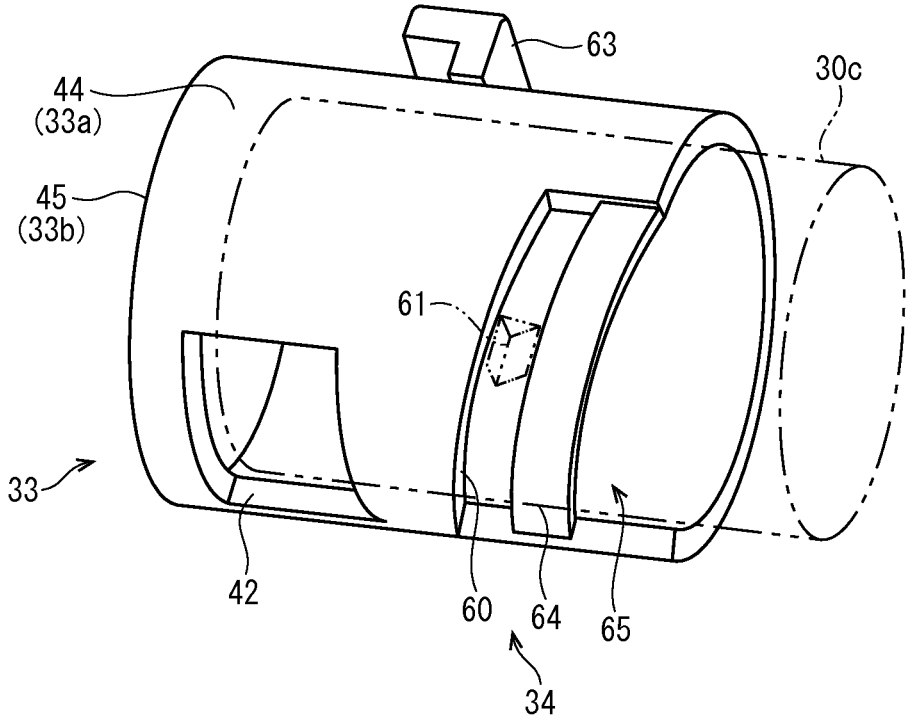
FIG. 5A is a perspective view of a shutter of the cleaning unit, in a side view, according to the embodiment of the present disclosure.
Figure 5B:
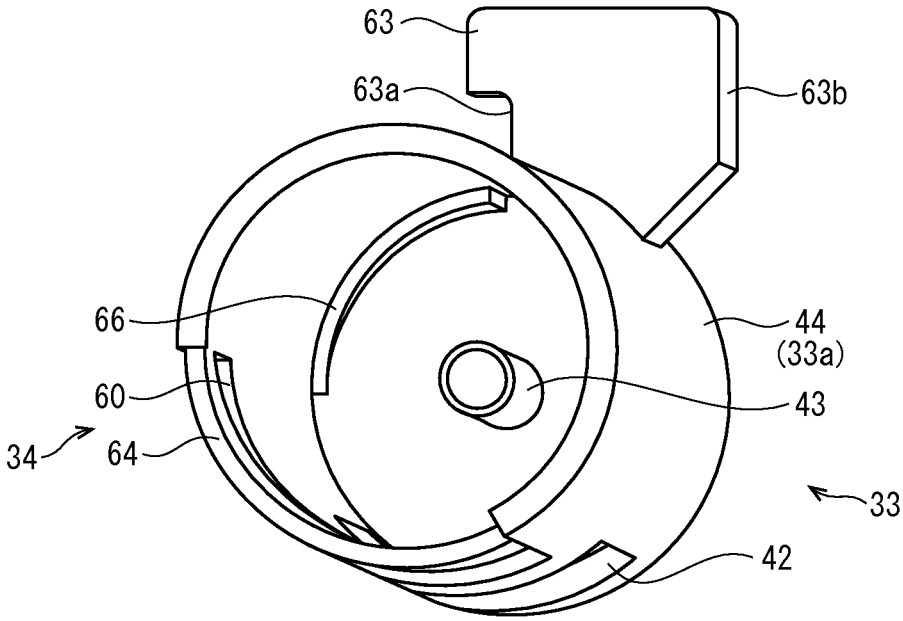
FIG. 5B is a perspective view of the shutter of the cleaning unit, as viewed from an axial direction, according to the embodiment of the present disclosure.

Next, with reference to FIGS. 2 to 5A and 5B, the cleaning unit 26 of each drum unit 21 will be described. FIG. 4 is a perspective view of an internal structure of the cleaning unit 21. FIGS. 5A and 5B are perspective views of a shutter 33 of the cleaning unit 21. Since four cleaning units 26 have the similar configuration to each other, in the following, one cleaning unit 26 will be described.

As shown in FIGS. 2 and 3, the cleaning unit 26 is provided with a casing 30, a cleaning member 31, a first screw 32, the shutter 33, a shutter moving mechanism 34 and a conveying body moving mechanism 35. The casing 30 constitutes main appearance. The cleaning member 31 eliminates the waste toner from the image forming face of the photosensitive drum 24. The first screw 32 as a waste toner conveying body conveys the waste toner inside a first conveying channel 36 arranged in the casing 30 to a waste toner case 59. The shutter 33 is provided so as to open/close the first conveying channel 36. The shutter moving mechanism 34 moves the shutter 33 to a predetermined position. The conveying body moving mechanism 35 moves the first screw 32 in an axial direction.

The casing 30 is configured to support the cleaning member 31 and others. The casing 30 is composed of a casing main body 30*a*, an upstream side case part 30*b* and a downstream side case part 30*c* in a body. The casing main body 30*a* is extended in an axial direction of the photosensitive drum 24 and formed in a roughly box-like shape opened at the photosensitive drum 24's side. The upstream side case part 30*b* is formed so as to protrude from a lower part of one end (a right end in FIG. 2) of the casing main body 30*a* to the outside (the right side). The downstream side case part 30*c* is formed so as to protrude from a lower part of another end (a left end in FIG. 2) of the casing main body 30*a* to the outside (the left side). In the prevent disclosure, the one end is often called as an "upstream" and the other end is often called as a "downstream".

The casing main body 30*a* is formed shorter than a length in the axial direction of the photosensitive drum 24. To both ends of an upper part of the casing main body 30*a*, arm parts 30*d* connected to the supporting frames 23 are formed, respectively. The upstream side case part 30*b* and downstream side case part 30*c* are cylindrically formed. An upstream end face of the upstream side case part 30*b* and a downstream end face of the downstream side case part 30*c* are opened.

At the lower side the casing main body 30*a*, the first conveyance channel 36 is arranged. The first conveyance channel 36 is extended in an axial direction from the upstream side case part 30*b* to the downstream side case part 30*c* (refer to FIG. 4). In a bottom face at the downstream side of the downstream side case part 30*c*, a rectangular first delivery port 37 is formed by cutting the bottom face from the downstream side to communicate with the first conveyance channel 36 (refer to FIG. 11A and other figures). To the first delivery port 37, a waste toner conveying device 50 mentioned below is connected via the shutter 33 (refer to FIG. 6).

As shown in FIG. 4, in a connecting portion of the casing main body 30*a* and upstream side case part 30*b*, a case side bearing part 38 is formed to rotatably support an upstream end part of the first screw 32. In an upstream end face (an open face), a screw bearing part 39 is arranged. The screw bearing part 39 rotatably supports the upstream end part of the first screw 32 penetrating the case side bearing part 38 and extending further to the upstream side.

As shown in FIG. 3, the cleaning member 31 is composed of a cleaning roller 31*a* and a cleaning blade 31*b* coming into slidably contact with the image forming face of the photosensitive drum 24.

Both end parts in an axial direction of the cleaning roller 31*a* are rotatably supported by the upper part of the casing main body 30*a*. A part of a circumference face of the cleaning roller 31*a* is exposed from an opening portion of the casing 30 and comes into slidably contact with the image forming face of the photosensitive drum 24. The cleaning roller 31*a* is driven by the driving motor (not shown) so as to rotate in an opposite direction to the photosensitive drum 24. The cleaning roller 31*a* glides the image forming face of the photosensitive drum 24 after the toner image is first-transferred. Thereby, the waste toner adhered on the surface of the photosensitive drum 24 is eliminated.

The cleaning blade 31*b* is made, for example, of polyurethane rubber. The cleaning blade 31*b* is fixed by the lower part of the casing main body 30*a*. An upper part of the cleaning blade 31*b* is a free end. The upper part of the cleaning blade 31*b* is pressured to the photosensitive drum 24 by own elastic force. The cleaning blade 31*b* comes into contact with the photosensitive drum 24 in a counter direction to a rotating direction of the photosensitive drum 24. The cleaning blade 31*b* scrapes the waste toner and others on the image forming face of the photosensitive drum 24. In order to pressure the cleaning blade 31*b* to the photosensitive drum 24 by a predetermined pressure force, a biasing part may be provided.

As shown if FIGS. 3 and 4, the first screw 32 is composed of a rotation shaft part 32*a* and a helical screw blade 32*b* extended along the first conveying channel 36. The screw blade 32*b* is fixed so as to protrude in a radial direction from a circumference face of the rotation shaft part 32*a*. The first screw 32 is rotatably supported by the casing 30 and the detail is mentioned below.

In the upstream side of the first screw 32, a flange part 40 is formed to protrude in a radial direction at an inner (other end side) position of the case side bearing part 38. The first screw 32 penetrates the upstream side case part 30*b* and is extended further to the upstream side. To the upstream end part of the first screw 32, a following gear 41 is pivotally supported.

As shown in FIGS. 2 and 4, the shutter 33 is formed a bottomed cylinder-like shape. The shutter 33 is attached and fitted to the opening face of the downstream side case part 30*c* from the downstream side so as to close the opening face. As shown in FIG. 5A, in a circumference wall 33*a* of the shutter 33, a rectangular ejecting port 42 is opened. As shown in FIG. 5B, in an inside end face of a bottom wall 33*b* of the shutter 33, a cylindrical shutter side bearing part 43 is formed to rotatably support a downstream end part of the first screw 32. The shutter side bearing part 43 is protruded from the center in an inside end face of the shutter 33 to the upstream side in an axial direction. The shutter side bearing part 43 is insertably/extractably inserted into the rotation shaft part 32*a* of the first screw 32. Therefore, both end parts of the first screw 32 are pivotally supported by the shutter side bearing part 43 and case side bearing part 38 (refer to FIG. 4).

Figure 6:
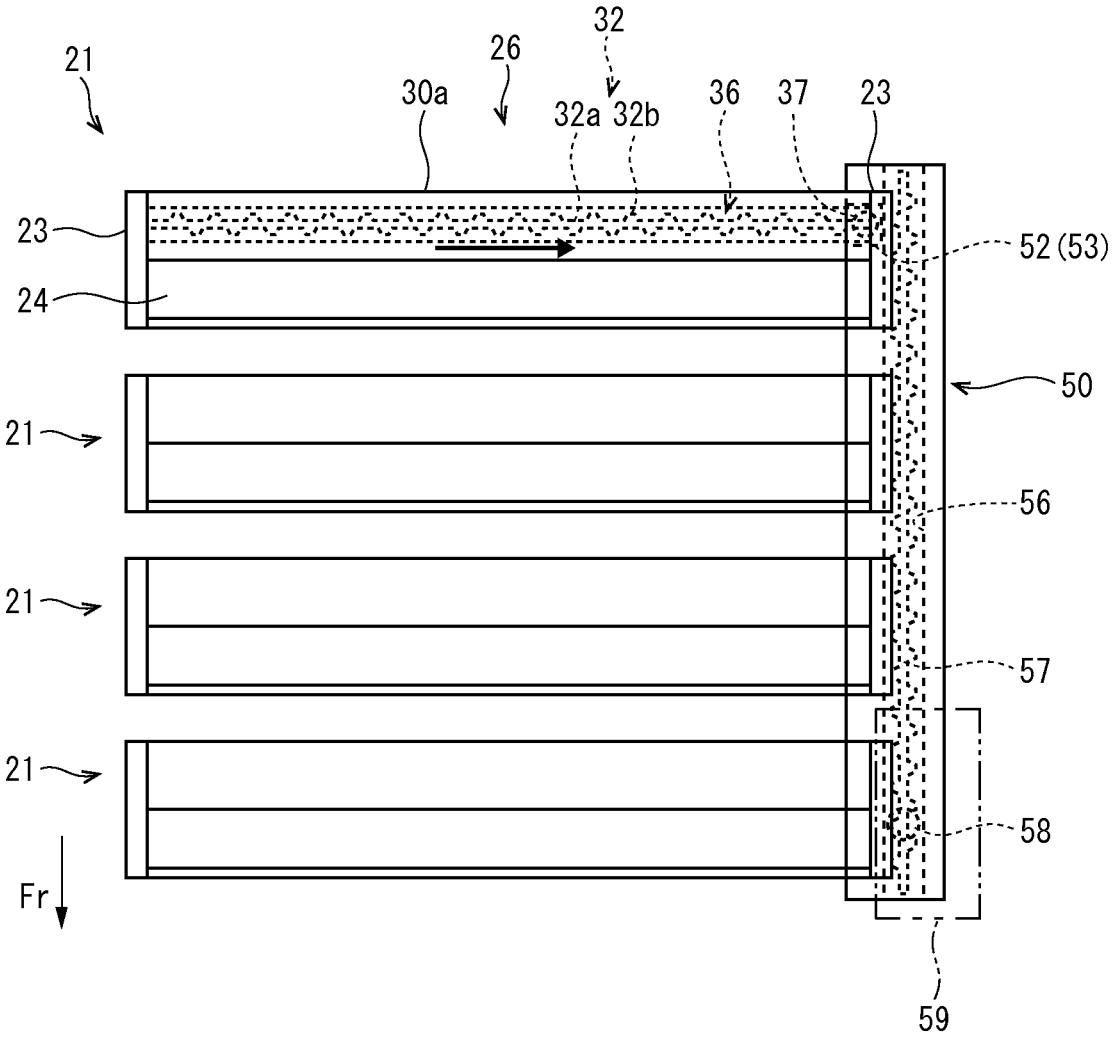
FIG. 6 is a plan view schematically showing the drum unit and a waste toner conveying device in the color printer according to the embodiment of the present disclosure.
Figure 7:
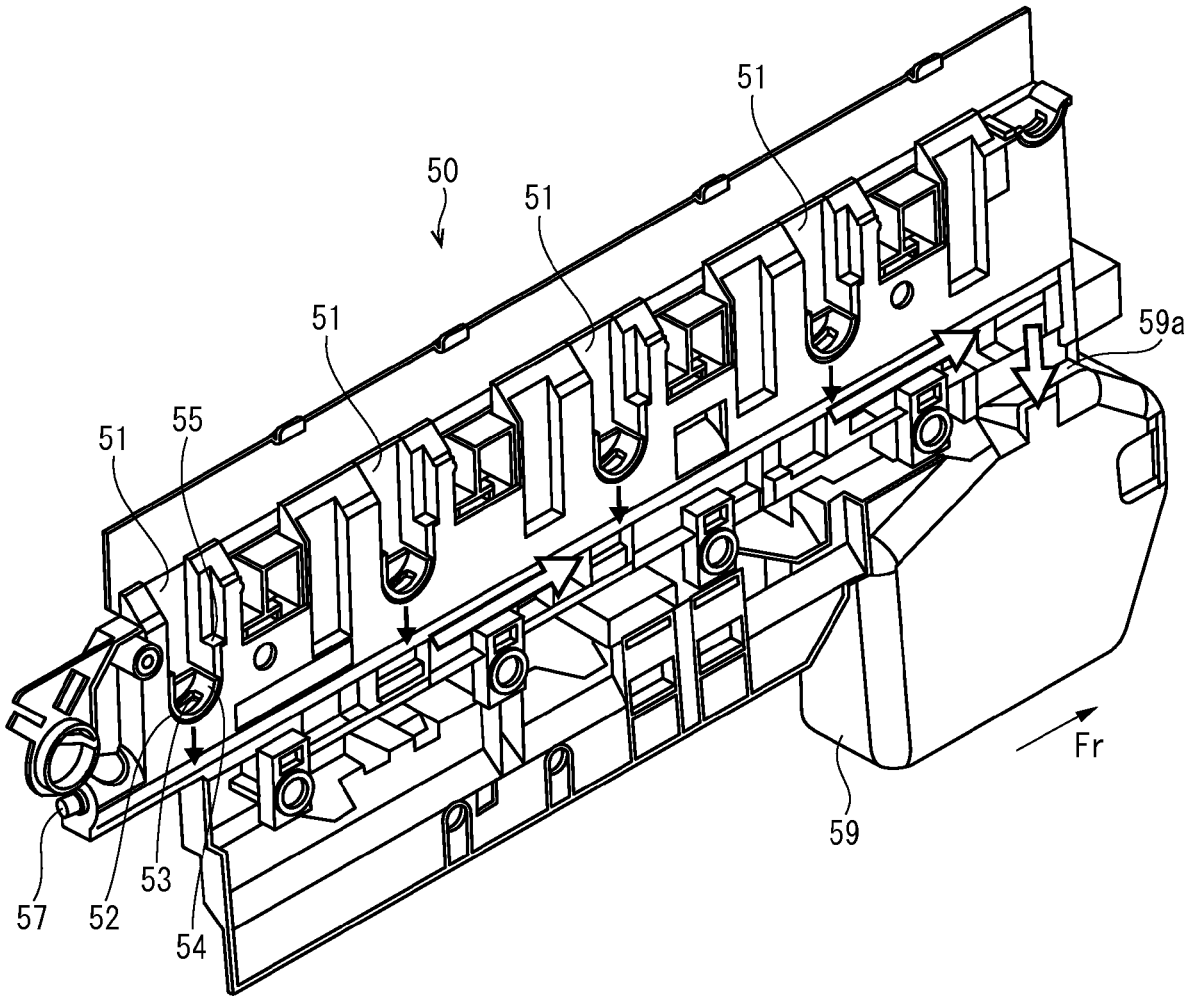
FIG. 7 is a perspective view showing the waste toner conveying device and a waste toner case in the color printer according to the embodiment of the present disclosure.

Now, before describing the moving mechanisms 34 and 35 of the cleaning unit 26, with reference to FIGS. 6 and 7, the waste toner conveying device 50 to which the cleaning unit 26 of each drum unit 21 will be described. FIG. 6 is a plan view schematically showing the drum unit and waste toner conveying device 50. FIG. 7 is a perspective view showing the waste toner conveying device 50 and waste toner case 59.

The waste toner conveying device 50 is formed in a roughly thick plate-like shape. The waste toner conveying device 50 is extended in the forward and backward directions over the four cleaning units 26 arranged in parallel (refer to FIG. 6). In one face of the waste toner conveying device 50, four unit connecting slots 51 are formed at regular intervals (refer to FIG. 7). To the four unit connecting slots 51, the first delivery ports 37 of the cleaning units 26 are connected, respectively. Since four unit connecting slots 51 have the similar configuration to each other, in the following, one unit connecting slot 51 will be described.

Figure 14A:
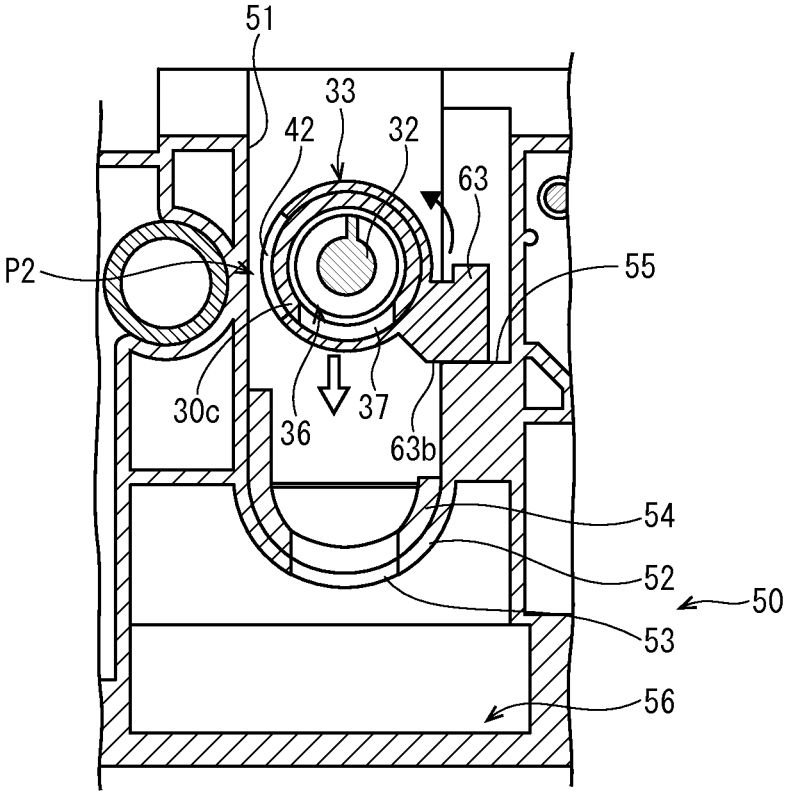
FIG. 14A is a sectional view showing the shutter moving mechanism, in the other case of the shutter being located the closing position, in the cleaning unit according to the embodiment of the present disclosure.

The unit connecting slot 51 is formed so as to be cut downward from an upper end face. Into the unit connecting slot 51, the shutter 33 of the cleaning unit 26 is inserted downward from an upper end. In a lower end part of the unit connecting slot 51, a semi-cylindrical unit contact part 52 is formed so as to correspond to the shape of the shutter 33. In a lower side circumference face of the unit contact part 52, a rectangular introduction port 53 is opened. On the other portions in the unit contact part 52 than the introduction port 53, a seal 54 made of elastic material, such as synthetic rubber, is arranged. Correctly, a rear end of the seal 54 is arranged so as to extend upward from the unit contact part 52 (refer to FIG. 14A and other figures).

Figure 14B:
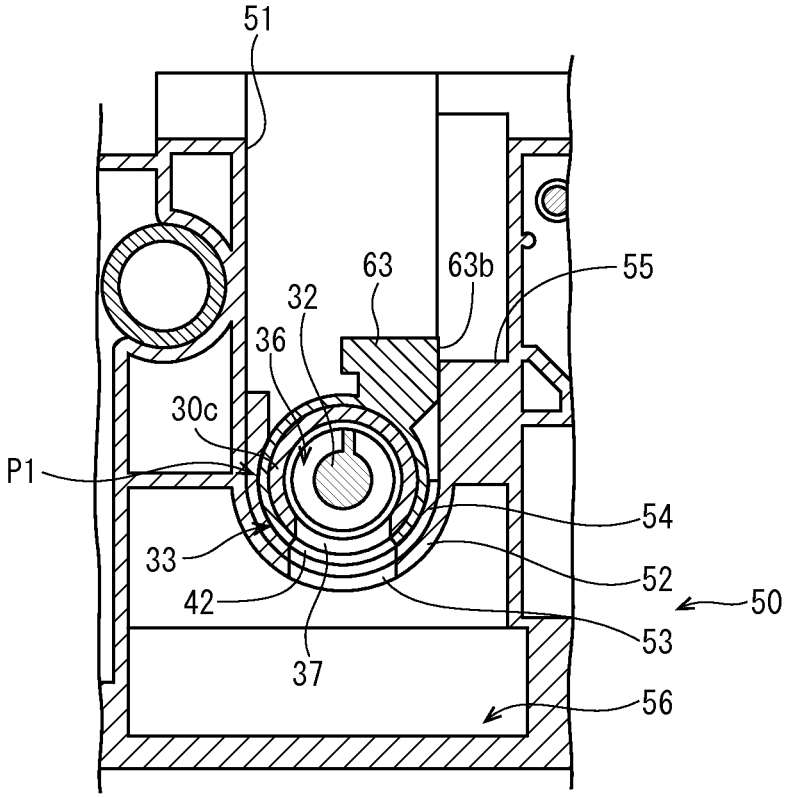
FIG. 14B is a sectional view showing the shutter moving mechanism, in the case of the shutter being located the opening position, in the cleaning unit according to the embodiment of the present disclosure.
Figure 15A:
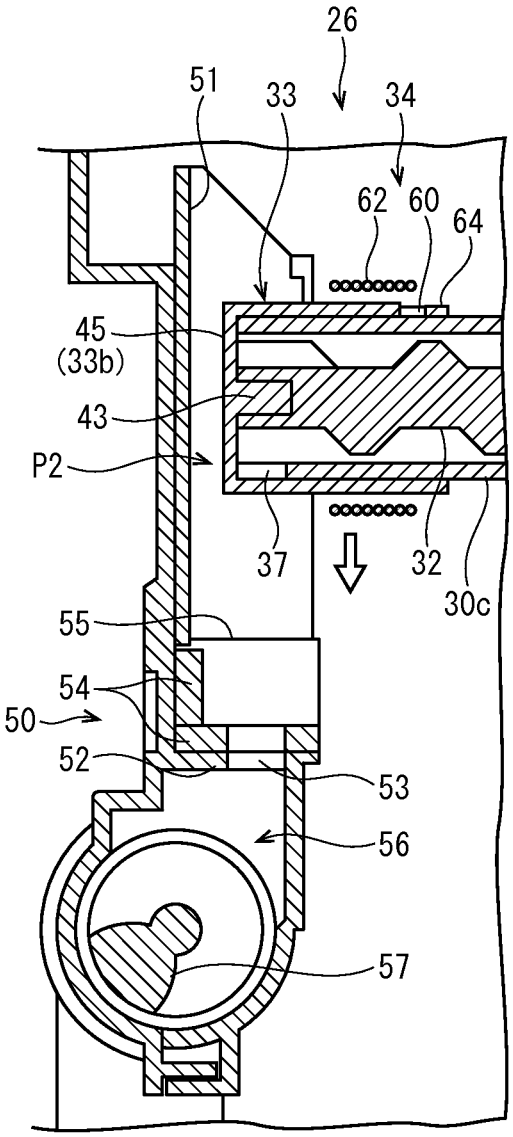
FIG. 15A is a sectional view showing the shutter moving mechanism and conveying body moving mechanism, in the other case of the shutter being located the closing position, in the cleaning unit according to the embodiment of the present disclosure.
Figure 15B:
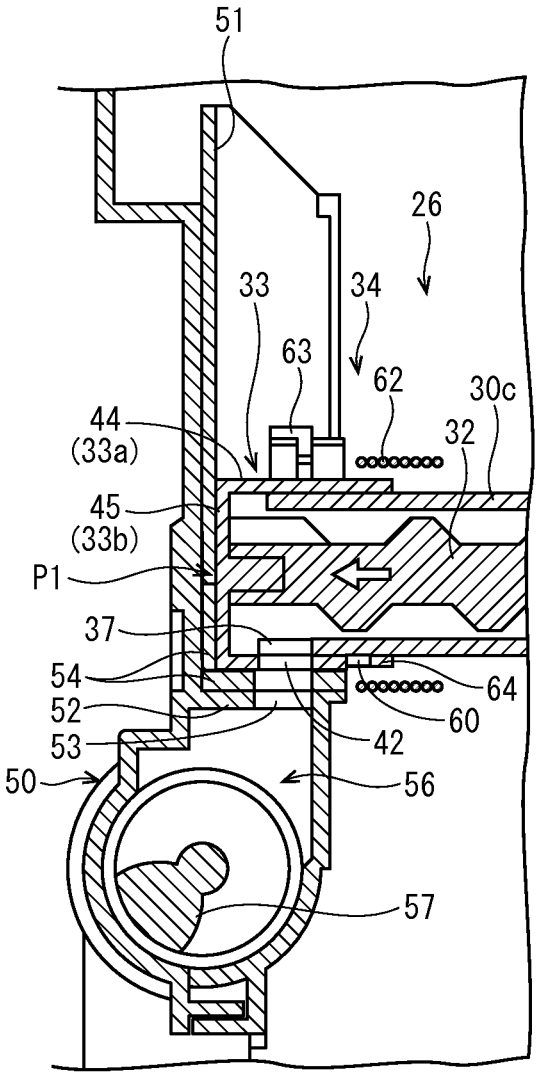
FIG. 15B is a sectional view showing the shutter moving mechanism and conveying body moving mechanism, in the case of the shutter being located the opening position, in the cleaning unit according to the embodiment of the present disclosure.

Incidentally, when the cleaning unit 26 is connected to the waste toner conveying device 50, via the ejecting port 42 of the shutter 33, the first delivery port 37 of the downstream side case part 30*c* is communicated with the introduction port 53 of the unit contact part 52 (refer to FIG. 14B). At this time, a lower side outer circumference face 44 of the circumference wall 33*a* and a lower side outer end face 45 of the bottom wall 33*b* are sealed together with a circumference edge of the ejecting port 42 by the seal 54 (refer to FIG. 15B).

In a front side face of the unit connecting slot 51, a contact reception part 55 is formed so as to have a difference at a slightly upward position from the unit contact part 52. An upper side portion from the contact reception part 55 in the unit connecting slot 51 is formed to have a width in the forward and backward directions sufficiently wider than a diameter of the shutter 33. A lower side portion from the contact reception part 55 in the unit connecting slot 51 is formed to have a roughly similar width in the forward and backward directions to the unit contact part 52.

In a lower part of the waste toner conveyance device 50, a second conveyance channel 56 is extended in the forward and backward directions so as to join the four introduction ports 53. Similarly to the first screw 32, in the second conveyance channel 56, a second screw 57 having a helical screw blade is arranged. Both end parts in an axial direction of the second screw 57 are rotatably supported by an inner wall of the second conveyance channel 56. The second screw 57 is driven and rotated by the driving motor (not shown). In a bottom face of a front end part of the second conveyance channel 56, a second delivery port 58 is opened. To the second delivery port 58, a collecting port 59*a* of the waste toner case 59 is connected.

Now, conveyance of the waste toner in one cleaning unit 26 will be described.

The waste toner eliminated from the photosensitive drum 24 by the cleaning unit 26 falls down to the first conveyance channel 36 of the casing 30. The waste toner collected in first conveyance channel 36 is conveyed to the first delivery port 37 and ejecting port 42 by the rotation of the first screw 32. The waste toner is passed through the introduction port 53 connected to the ejecting port 42 via the seal 54 and flowed into the second conveyance channel 56 (refer to an arrow in FIG. 7). The waste toner collected in the second conveyance channel 56 is conveyed to the second delivery port 58 by the rotation of the second screw 57. The waste toner is passed through the collecting port 59*a* connected to the second delivery port 58 and collected in the waste toner case 59 (refer to an outline arrow in FIG. 7).

Figure 8:
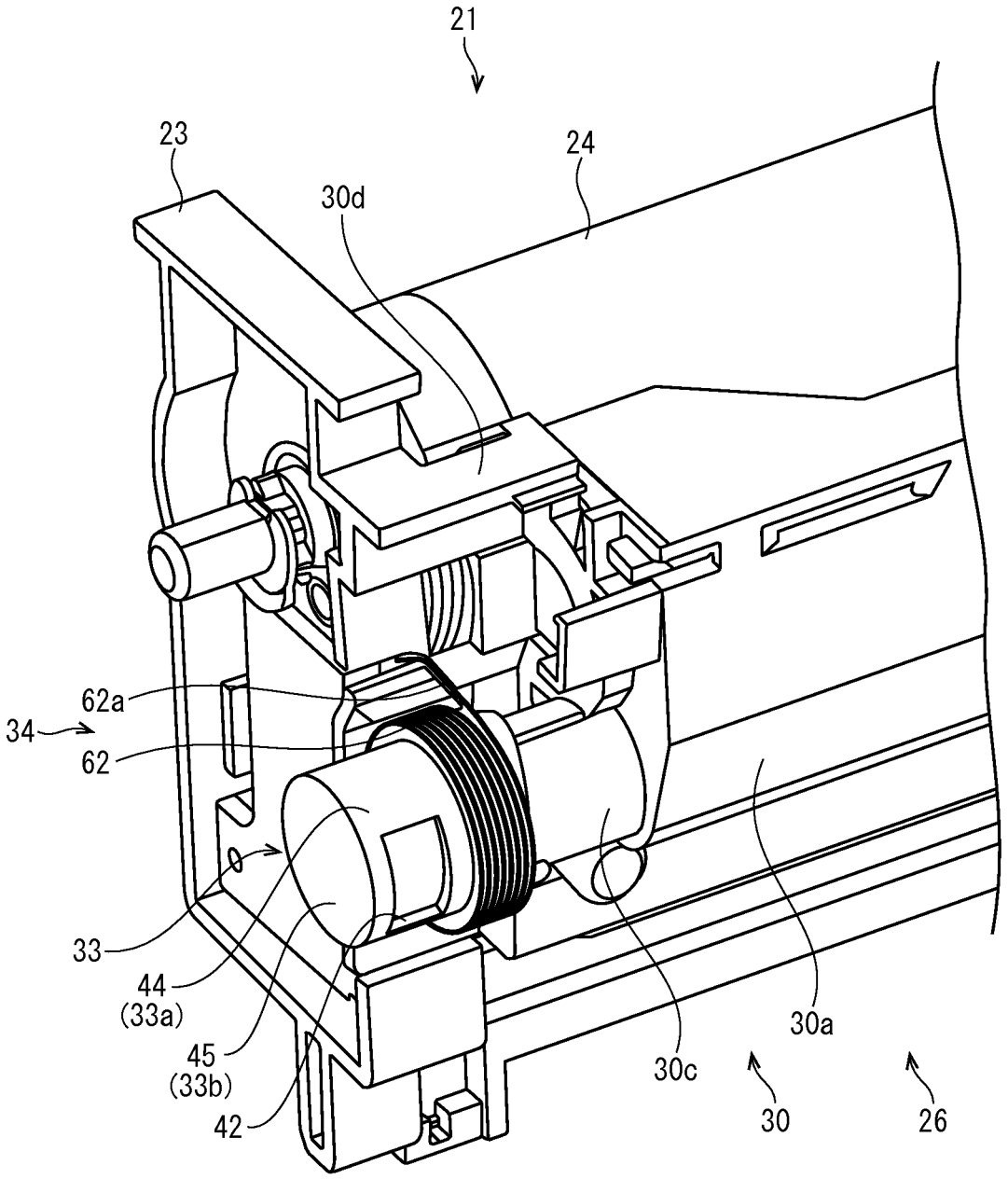
FIG. 8 is a partially perspective view showing a shutter moving mechanism of the cleaning unit according to the embodiment of the present disclosure.
Figure 9A:
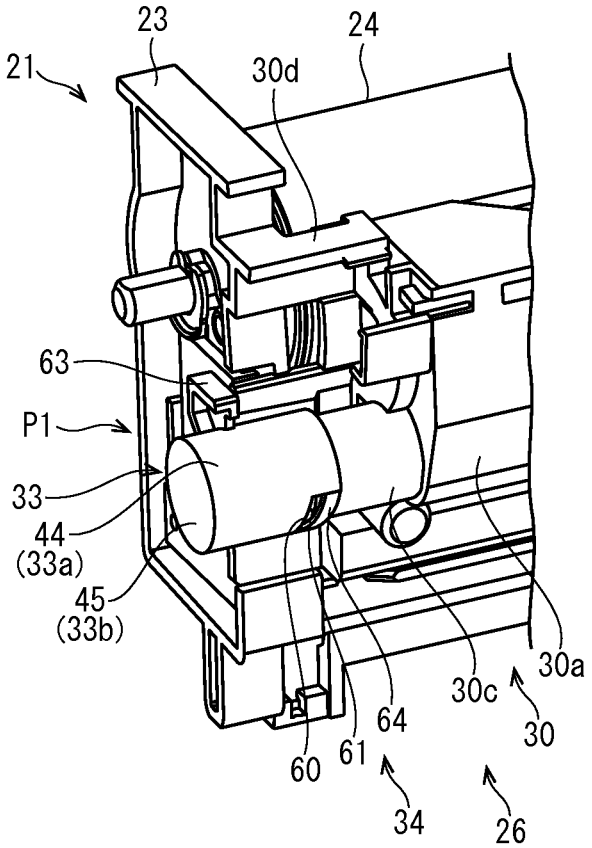
FIG. 9A is a perspective view showing the shutter located at an opening position as a portion of the shutter moving mechanism of the cleaning unit according to the embodiment of the present disclosure.
Figure 9B:
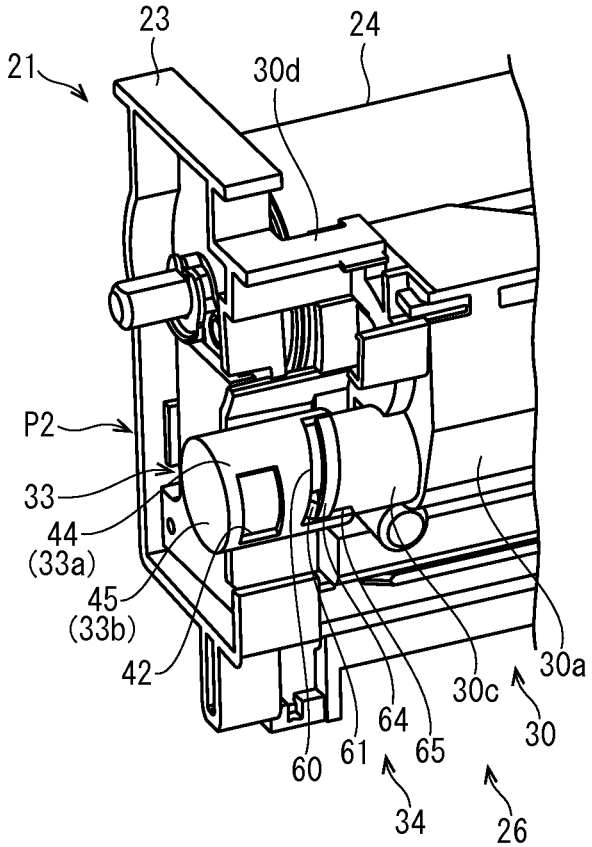
FIG. 9B is a perspective view showing the shutter located at a closing position as a portion of the shutter moving mechanism of the cleaning unit according to the embodiment of the present disclosure.
Figure 10A:
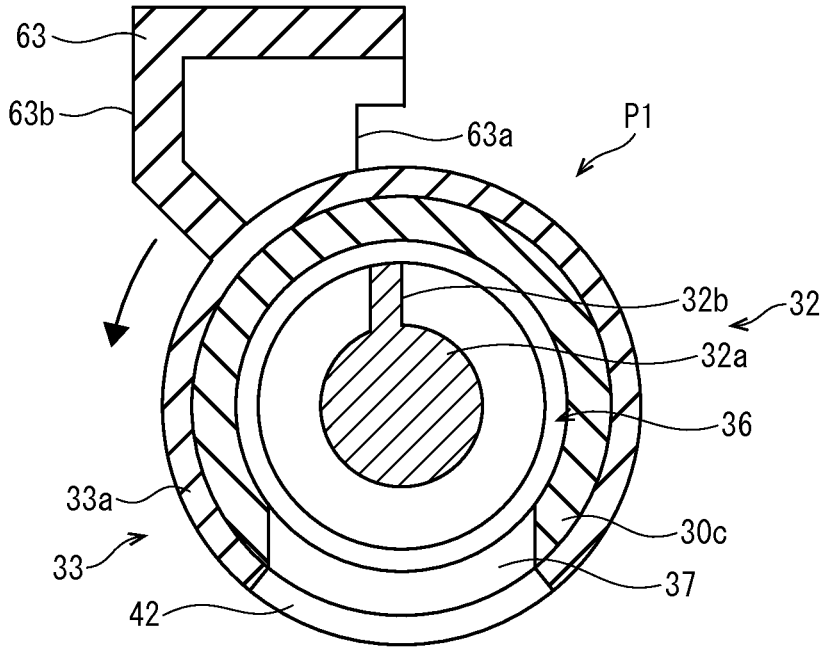
FIG. 10A is a sectional view showing the shutter in a state of being located the opening position in the cleaning unit according to the embodiment of the present disclosure.
Figure 10B:
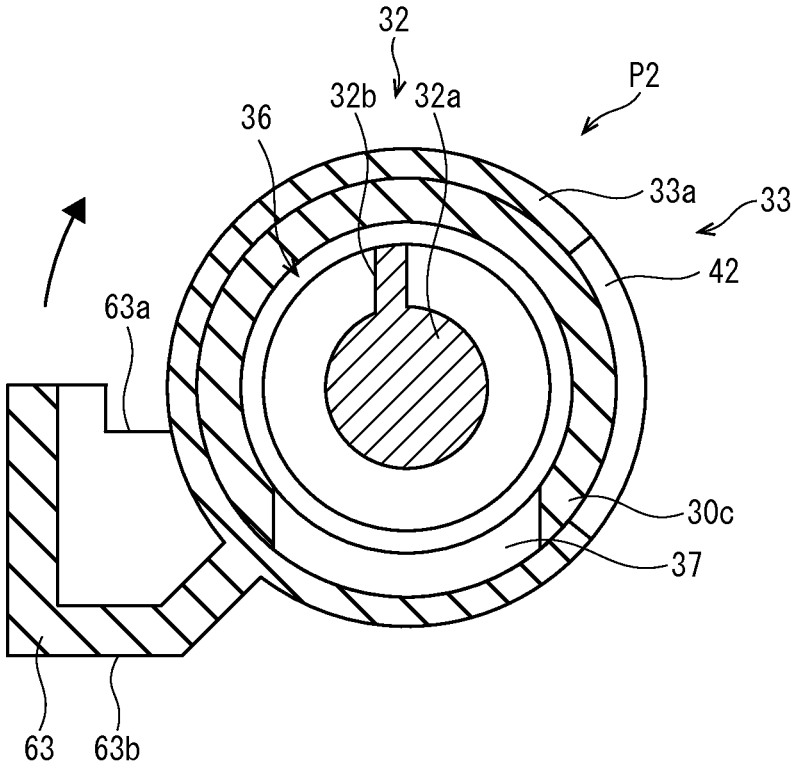
FIG. 10B is a sectional view showing the shutter in another state of being located the closing position in the cleaning unit according to the embodiment of the present disclosure.
Figure 11A:
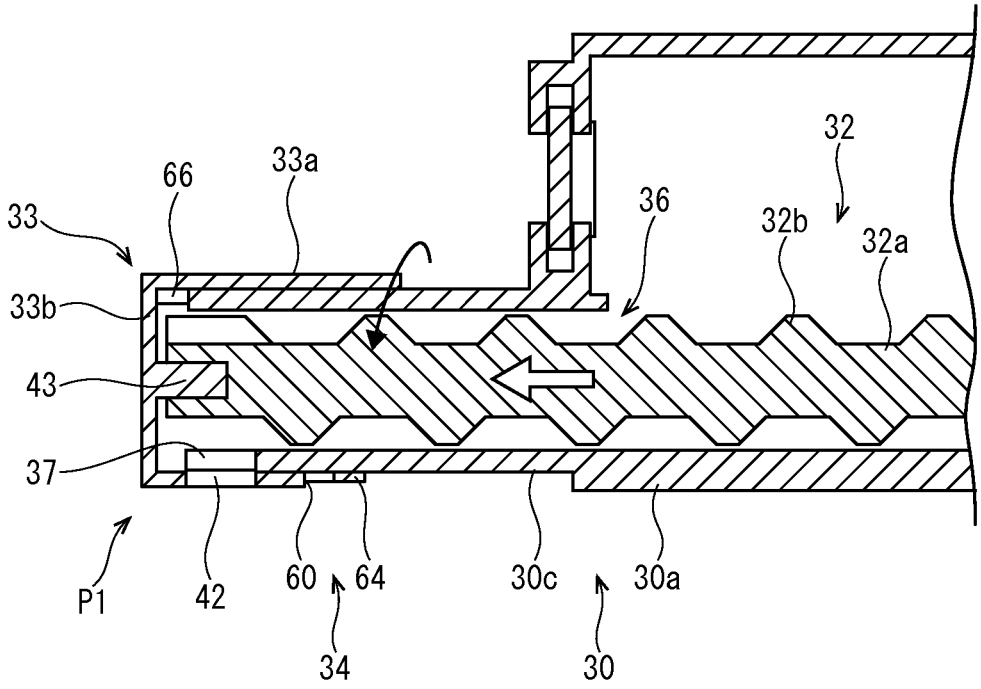
FIG. 11A is a sectional view showing the shutter in the state of being located the opening position, shutter moving mechanism and a conveying body moving mechanism in the cleaning unit according to the embodiment of the present disclosure.
Figure 11B:
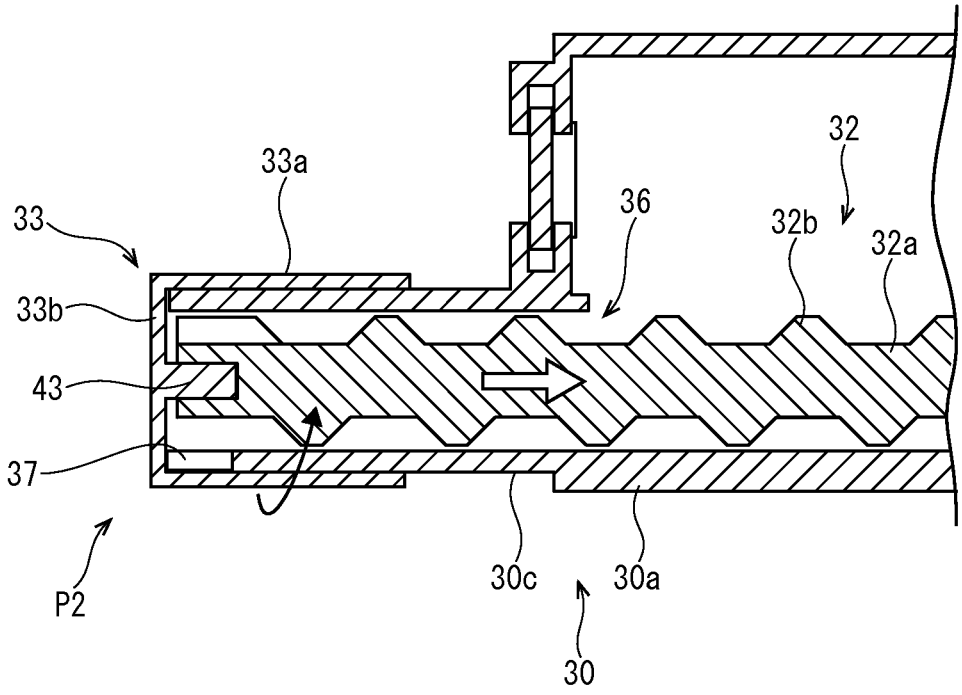
FIG. 11B is a sectional view showing the shutter in the other state of being located the closing position, shutter moving mechanism and conveying body moving mechanism in the cleaning unit according to the embodiment of the present disclosure.

Next, with reference to FIGS. 5A, 5B, 8 to 11A, and 11B, the shutter moving mechanism 34 of the cleaning unit 26 will be described. FIG. 8 is a partially perspective view showing the shutter moving mechanism 34. FIGS. 9A and 9B are partially perspective views showing the shutter moving mechanism 34. FIGS. 10A and 10B are sectional views showing the shutter 33 and others. FIGS. 11A and 11B are sectional views useful for understanding operation of the shutter moving mechanism 34 and conveying body moving mechanism 35.

As shown in FIGS. 5A and 5B, the shutter moving mechanism 34 is configured to have an oblique groove 60, a protrusion 61, a torsion coil spring 62 and a lever 63. The oblique groove 60 is obliquely formed in the circumference wall 33*a* of the shutter 33 so as to move the shutter 33 between an opening position P1 and a closing position P2. The protrusion 61 is formed in an outer circumference face of the casing 30 so as to engage with the oblique groove 60. The torsion coil spring 62 applies a biasing force to the shutter 33 so as to move the shutter to the closing position P2 (refer to FIG. 8). The lever 63 is protruded in a radial direction from a circumference face of the shutter 33 and manipulated so as to move the shutter 33 to the opening position P1 against the biasing force of the torsion coil spring 62.

The oblique groove 60 is formed to penetrate the circumference wall 33*a* of the shutter 33 at the upstream side from the ejecting port 42. As shown in FIG. 5A, the oblique groove 60 is formed so as to hollow out a portion of the circumference wall 33*a* that is inclined upward to the upstream side in an axial direction and has a constant width in the axial direction. At the upstream side from the oblique groove 60, a thin wall 64 is formed along the oblique groove 60. The thin wall 64 is formed to be slightly thinner than the circumference wall 33*a* of the shutter 33. The thin wall 64 is formed to have a roughly equal width to the oblique groove 60. At an opening face side of the shutter 33, a notch part 65 is obliquely cut out along the thin wall 64.

As shown in FIG. 5B, in the inside end face of the bottom wall 33*b* of the shutter 33, a slope-like inclined part 66 is formed to be inclined in the same direction and at the same angle as the oblique groove 60. The inclined part 66 is formed at a shifted position around the axis from the oblique groove 60. With the inclined part 66, an upper side of the downstream end face of the downstream side case part 30*c* comes into contact. The downstream end face of the downstream side case part 30*c* is inclinedly formed so as to correspond to the inclined part 66.

As shown in FIG. 5A, the protrusion 61 is formed in a triangle pole shape. One edge line of the protrusion is protruded in a radial direction from the outer circumference face of the downstream side case part 30*c*. The protrusion 61 engages with the oblique groove 60 so as to come into slidably contact with the oblique groove 60. The protrusion 61 is moved along the oblique groove 60 relatively.

As shown in FIG. 8, the torsion coil spring 62 is arranged to be wound around the shutter 33 so as to cover the oblique groove 60. One arm part 62*a* of the torsion coil spring 62 is stopped in an engaged state with the downstream side supporting frame 23 (not shown). Another arm part 62*a* of the torsion coil spring 62 is stopped in an engaged state with the lever 63 (not shown). Thereby, the torsion coil spring 62 biases the shutter 33 in a right-handed rotation in FIGS. 10A and 10B.

As shown in FIG. 5B, the lever 63 is formed in a hook-like shape in a side view. In the lever 63, an engaging-stopped part 63*a* recessed in a circumference direction is formed. With the engaging-stopped part 63*a*, the other arm part 62*a* of the torsion coil spring 62 is stopped in the engaged state. In a facing side to the engaging-stopped part 63*a* of the lever 63, a plane contact part 63*b* is formed. A distal end portion extended in a radial direction in the lever 63 is formed to be bent to the downstream side in an axial direction.

The shutter moving mechanism 34 moves the shutter 33 between the opening position P1 (refer to FIG. 9A and other figures) and the closing position P2 (refer to FIG. 9B and other figures). The opening position P1 is a shutter 33's position when the shutter 33 is rotated in one direction around the axis, and simultaneously, the outer end face 45 of the shutter is moved in an axial direction so as to contact with the seal 54, and then, the ejecting port 42 is opened. The closing position P2 is another shutter 33's position when the shutter 33 is rotated in another direction around the axis, and simultaneously, the outer end face 45 of the shutter is moved in the axial direction so as to be separated from the seal 54, and then, the ejecting port 42 is closed.

When the shutter 33 is located at the opening position P1, the shutter 33 is positioned against the biasing force of the torsion coil spring 62 and the ejecting port 42 of the shutter 33 is directed downward. Therefore, the ejecting port 42 is positioned so as to correspond to the first delivery port 37 of the downstream side case part 30*c* (refer to FIGS. 10A and 11A). That is, the ejecting port 42 (the first delivery port 37) is opened.

By contrast, when the shutter 33 is located at the closing position P2, the shutter 33 is rotated along the oblique groove 60 and inclined part 66 by the biasing force of the torsion coil spring 62 and the ejecting port 42 of the shutter 33 is directed sideward. Therefore, the ejecting port 42 is positioned so as to be shifted from the first delivery port 37 (refer to FIGS. 10B and 11B). That is, the ejecting port 42 (the first delivery port 37) is closed. At this time, to the ejecting port 42, an outside face of the downstream side case part 30*c* faces. Since the shutter 33 is rotated along the oblique groove 60, the shutter 33 is slid to the upstream side in an axial direction (refer to FIG. 11B).

Figure 12A:
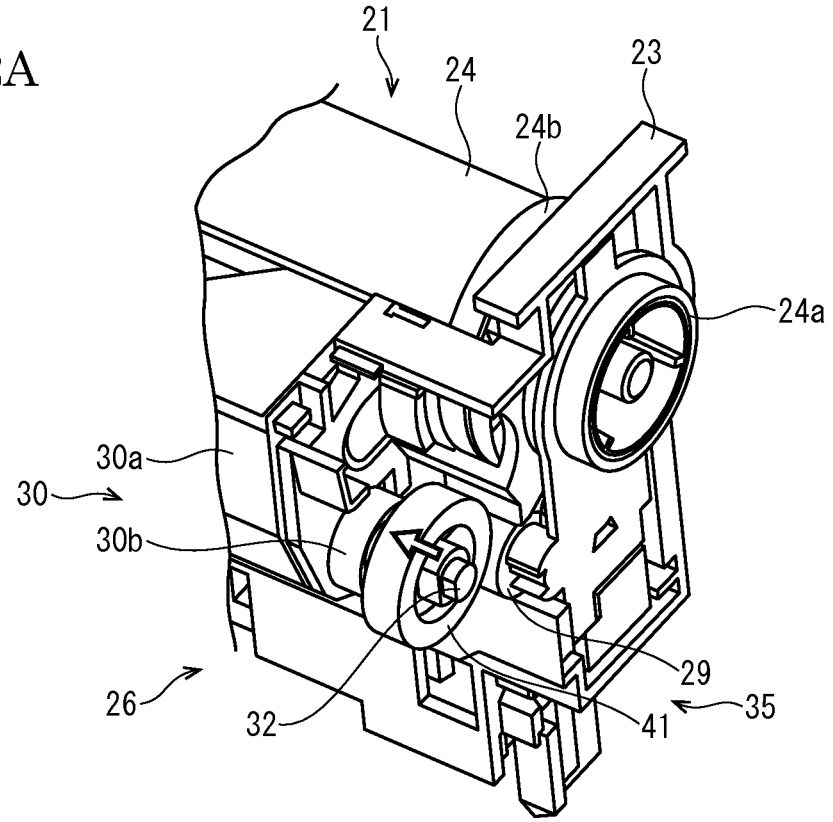
FIG. 12A is a perspective view showing the conveying body moving mechanism, in a case of the shutter being located the opening position, in the cleaning unit according to the embodiment of the present disclosure.
Figure 12B:
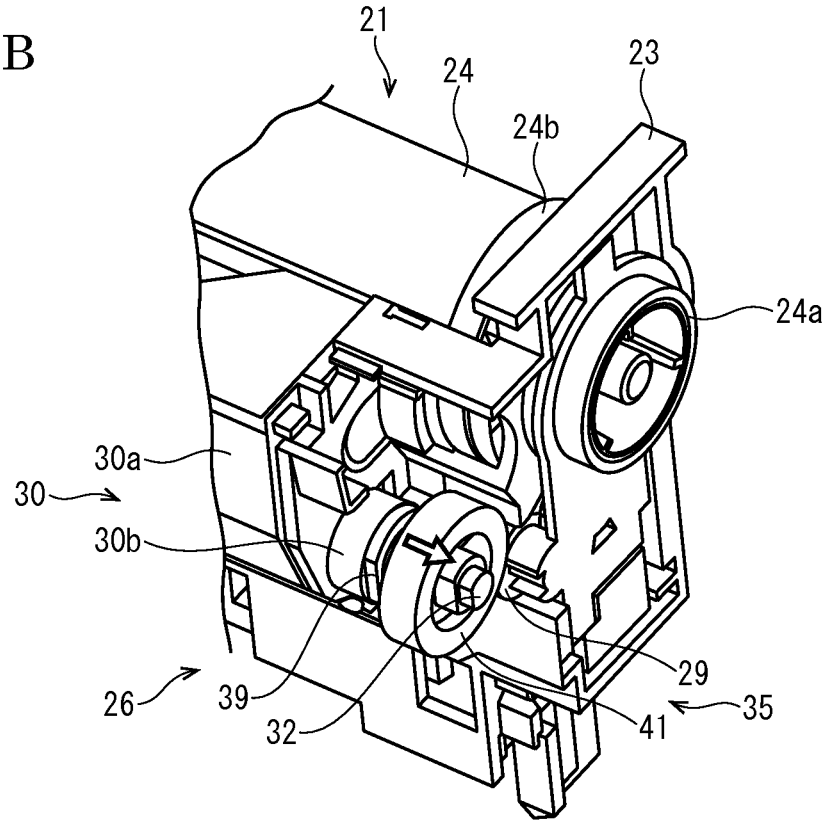
FIG. 12B is a perspective view showing the conveying body moving mechanism, in another case of the shutter being located the closing position, in the cleaning unit according to the embodiment of the present disclosure.
Figure 13A:
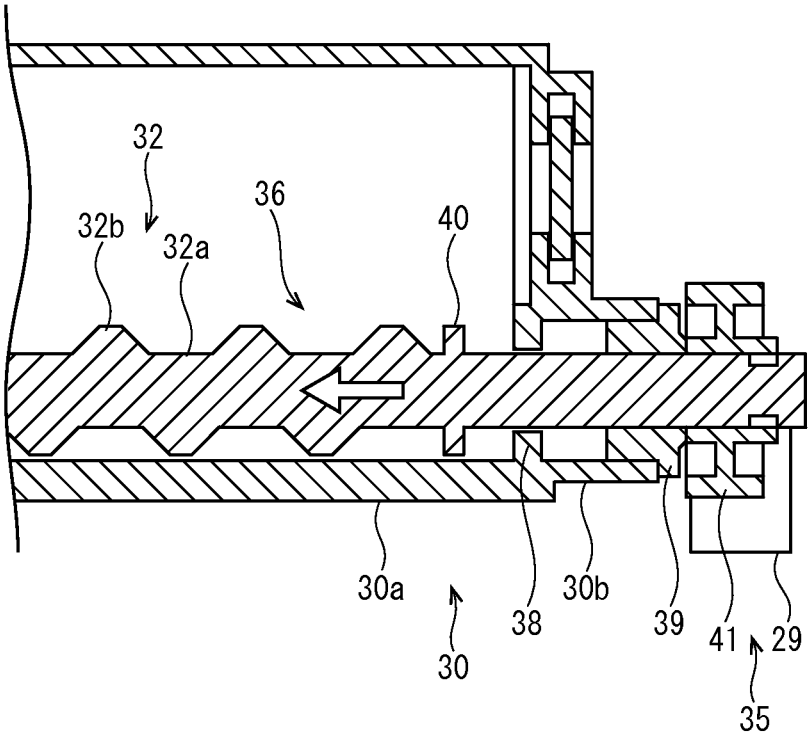
FIG. 13A is a sectional view showing the conveying body moving mechanism, in the case of the shutter being located the opening position, in the cleaning unit according to the embodiment of the present disclosure.
Figure 13B:
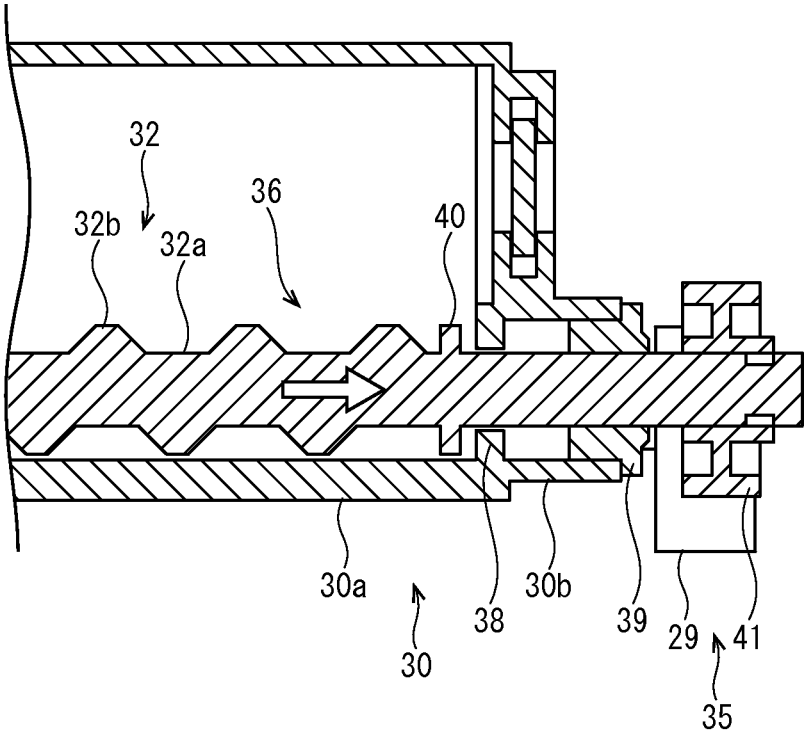
FIG. 13B is a sectional view showing the conveying body moving mechanism, in the other case of the shutter being located the closing position, in the cleaning unit according to the embodiment of the present disclosure.

Next, with reference to FIGS. 11A, 11B to 13A, and 13B, the conveying body moving mechanism 35 of the cleaning unit 26 will be described. FIGS. 12A and 12B are perspective views useful for understanding operation of the conveying body moving mechanism 35. FIGS. 13A and 13B are sectional views useful for understanding the operation of the conveying body moving mechanism 35.

The conveying body moving mechanism 35 is configured to the interlock with the movement of the shutter 33 by the shutter moving mechanism 34 and to move the first screw 32 in an axial direction in the same direction as the shutter 33.

Concretely, as shown in FIGS. 12A, 12B, 13A and 13B, the conveying body moving mechanism 35 is configured to have the drive gear 29, following gear 41 and torsion coil spring 62 (refer to FIG. 8). The drive gear 29 rotates the photosensitive drum 24 via the drum drive gear wheel 24*b*. The following gear 41 meshes with the drive gear 29 to rotate the first screw 32. The torsion coil spring 62 is used not only for the shutter moving mechanism 34, but also for the conveying body moving mechanism 35

The drive gear 29 and following gear 41 are composed of respective helical gears. The drive gear 29 has a plurality of left-hand helix tooth. The following gear 41 has a plurality of right-hand helix tooth.

When the drive motor is driven to rotate the drive gear 29, the following gear 41 meshed with the drive gear 29 receives thrust loading to the downstream (a left-hand side in FIG. 13A and other figures). That is, the following gear 41 applies the thrust loading to the first screw 32 so as to move the shutter 33 to the opening position P1 when the drive gear 29 is driven (when rotation torque is applied). Thereby, the first screw 32 is moved to the downstream side in an axial direction (refer to FIG. 11A and other figures).

Incidentally, when a drive force is not applied to the drive gear 29, since the thrust loading is not generated, the first screw 32 can be moved to the upstream side in an axial direction together with the shutter 33 by the biasing force of the torsion coil spring 62 (refer to FIG. 11B and other figures).

Correctly, the first screw and shutter 33 can be slid in the axial direction by backlash between the drive gear 29 and following gear 41.

Next, with reference to FIGS. 14A, 14B, 15A and 15B, workings of the shutter moving mechanism 34 and conveying body moving mechanism 35 will be described. FIGS. 14A, 14B, 15A and 15B are sectional views useful for understanding the workings of the shutter moving mechanism and the others when the cleaning unit 26 is attached/detached.

First, a case of attaching one drum unit 21 (cleaning unit 26) to the apparatus main body 2 will be described. Incidentally, the shutter 33 of the cleaning unit 26 before the attachment is located at the closing position P2 by the biasing force of the torsion coil spring 62 (refer to FIGS. 14A and 15A).

A user opens the apparatus main body 2 by a given manner to expose the waste toner conveying device 50. Subsequently, the user inserts the shutter 33 (the downstream side case part 30*c*) of the cleaning unit 26 into the unit connecting slot 51 of the waste toner conveying device 50 from the upper side to the lower side.

When the insertion of the shutter 33 advances, the contact part 63*b* formed in the lever 63 of the shutter 33 comes into contact with the contact reception part 55 of the unit connecting slot 51. Therefore, the insertion of the lever 63 to a lower side than the contact reception part 55 is restricted (refer to FIG. 14A). When the insertion of the shutter 33 further advances, the lever 63 contacted with the contact reception part 55 rotates the shutter 33 against the biasing force of the torsion coil spring 62. In detail, the shutter 33 is guided by the oblique groove 60 coming into slidably contact with the protrusion 61, and by the inclined part 66 coming into slidably contact with the downstream end face of the downstream side case part 30*c* so as to be rotated (in a left-handed rotation in FIG. 14A and other figures), and simultaneously, to be slid to the downstream side in an axial direction (refer to FIG. 15B).

When the shutter 33 reaches the unit contact part (the seal 54), the ejecting port 42 is moved to a position where the first delivery port 37 of the downstream side case part 30*c* communicates with introduction port 53 of the unit contact part 52 (refer to FIG. 14B). At this time, the lower side outer circumference face 44 and lower side outer end face 45 of the shutter 33 are arranged in close contact with the seal 54. Therefore, a circumference edge part of the ejecting port 42 is sealed by the seal 54. That is, the shutter 33 has been moved at the opening position P1. Incidentally, at this time, the contact part 63*b* of the lever 63 comes into contact with a lower side face of the contact reception part 55.

In such a condition, when the rotation torque is applied to the drive gear 29, the thrust loading to the downstream side is generated in the following gear 41. By the thrust loading, the first screw 32 to which the following gear 41 is fixed is slid to the downstream side in an axial direction (refer to FIG. 15B). Thereby, it is possible to prevent a leak of the waste toner from the ejecting port 42, and simultaneously, to eject the waste toner in the first conveying channel 36 to the waste toner case 59.

Next, a case of detaching one drum unit 21 (cleaning unit 26) from the apparatus main body 2 will be described. Incidentally, in the case of detaching one drum unit 21 (cleaning unit 26) from the apparatus main body 2, the drive gear 29 (a drive motor) is stopped.

The user withdraws the drum unit 21 (the cleaning unit 26) connected to the waste toner conveying device 50 upward by a reverse procedure of the attachment. That is, the user separates the shutter 33 along the unit connecting slot 51 upward.

When the separation of the shutter 33 advances, the shutter 33 is rotated in an opposite direction to the rotation direction for the attachment by the biasing force of the torsion coil spring 62. In detail, the shutter 33 is guided by the oblique groove 60 and inclined part 66 to be rotated (in the right-handed rotation in FIG. 14B) and to be slid to the upstream side in an axial direction (refer to FIG. 15A). At this time, the thrust loading by the rotation torque is not applied to the following gear 41. Therefore, the biasing force of the torsion coil spring 62 is transmitted to the first screw 32 via the shutter side bearing part 43, and then, the first screw 32 is also slid to the upstream side in the axial direction (refer to FIG. 15A). Incidentally, by the flange part 40 arranged at the upstream side in the axial direction in the first screw 32, the movement of the first screw 32 in an upstream direction is restricted (refer to FIG. 13B). Similarly, the lever 63 is rotated in an opposite direction to the rotation direction for the attachment, and then, the lever 63 is separated from the contact part 63*b* when the separation of the shutter 33 advances.

In the color printer 1 according to the embodiment mentioned above, the shutter 33 has the openable/closable ejecting port 42 making the first conveying channel 36 and waste toner case 59 communicate with each other. The shutter 33 is arranged so as to contact with/separate from the seal 54 preventing the leak of the waste toner from the ejecting port 42. That is, when the shutter 33 is located at the opening position P1, the shutter 33 with the outer end face 45 contacts (closely contacts) with the seal 54 and the ejecting port 42 communicates with the waste toner case 59. Thereby, the collection of the waste toner is carried out in a leak prevented condition. By contrast, when the shutter 33 is located at the closing position P2, the close contact between the shutter 33 and seal 54 is released and the communication between the ejecting port 42 and waste toner case 59 is released. At this time, the outer end face 45 of the shutter 33 is separated from the seal to the upstream side in an axial direction. Therefore, it is possible to easily attach/detach the drum unit 21 having the cleaning unit 26 in a direction (the upward and downward directions) orthogonal to the axial direction. The outer end face 45 of the shutter 33 is separated from the seal 54 in the axial direction. Therefore, it is possible to smoothly rotate the shutter 33 and to appropriately close the ejecting port 42 by the shutter 33.

In addition, in the color printer 1 according to the embodiment, as the movement of the shutter 33 from the opening position P1 to the closing position P2 advances, the first screw 32 is moved so as to separate from the seal 54 in an axial direction. That is, by sliding the first screw 32 to the upstream side from the first conveying channel 36, the waste toner stayed in the vicinity of the upstream side in the ejecting port 42 is put aside in the upstream direction from the first conveying channel 36. Thereby, even if the close contact condition between the ejecting port 42 and seal 54 is released before the ejecting port 42 is completely closed, it is possible to prevent the leak of the waste toner stayed in the vicinity of the upstream side in the ejecting port 42. That is, by interaction between the shutter moving mechanism 34 and conveying body moving mechanism 35, it is possible to effectively prevent the leak of the waste toner from the ejecting port 42.

In addition, in the color printer 1 according to the embodiment, both end parts in an axial direction of the first screw 32 are pivotally supported by a pair of the bearing part 38 and 43. Thereby, stable rotation of the first screw 32 in the first channel 36 is secured. Therefore, it is possible to efficiently convey the waste toner. The shutter 33 has a function as a bearing of the first screw 32, in addition to a function of opening/closing the ejecting port 42. Therefore, it is possible to restrain an increase the number of components of a unit as compared to a case of providing individually a dedicated bearing of the first screw 32. That is, it is possible to decrease costs.

Further, in the color printer 1 according to the embodiment, to the shutter 33, the biasing force of the torsion coil spring 62 is always applied in a direction closing the ejecting port 42. Therefore, it is possible to suitably maintain the closing state of the shutter 33. When the shutter 33 is attached to the apparatus main body (the waste toner conveying device 50), the lever 63 comes into contact with the contact reception part 55 arranged at the waste toner conveying device 50's side, thereby correctly moving the shutter 33 to the opening position P1. Furthermore, by applying a drive force to the drive gear, the thrust loading is applied to the first screw 32 via the following gear 41, thereby moving the shutter 33 to the opening position P1. Thus, the conveying body moving mechanism 35 has a function of sliding the first screw 32 and a function of transmitting the drive force. Thereby, it is possible to omit a dedicated mechanism for sliding the first screw 32. Therefore, it is possible to simplify a configuration of a unit.

Although, in the embodiment, one waste toner case 59 is arranged for four colors of the waste toners, for example, the waste toner case 59 may be arranged for each color of the waste toner. The number of toner colors is not restricted by an example of the embodiment.

In the embodiment, the first screw 32 is supported in an insertable/extractable state in the shutter side bearing part 43. However, instead of such a supporting state, the first screw 32 may be supported so that rotation is allowed and insertion/extraction in an axial direction is not allowed.

While the preferable embodiment and its modified example of the color printer 1 including the cleaning unit 26 of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A cleaning unit comprising:

a cleaning member eliminating a waste toner from an image forming face of an image carrier forming a toner image;

a waste toner conveying body conveying the waste toner in a conveying channel arranged in a casing supporting the cleaning member to a waste toner case;

a cylindrical shutter having an openable/closable ejecting port making the conveying channel and waste toner case communicate with each other and being able to contact with/separate from a seal preventing a leak of the waste toner from the ejecting port;

a shutter moving mechanism moving the shutter between an opening position and a closing position, wherein, when the shutter is rotated in one direction around an axis, and simultaneously, moved in an axial direction so as to make an outer end face of the shutter contact with the seal, the shutter is located at the opening position and the ejecting port is opened, while, when the shutter is rotated in another direction around the axis, and simultaneously, moved in the axial direction so as to make the outer end face of the shutter separate from the seal, the shutter is located at the closing position and the ejecting port is closed; and a conveying body moving mechanism interlocking with the movement of the shutter by the shutter moving mechanism to move the waste toner conveying body in an axial direction in the same direction as the shutter, wherein the waste toner conveying body is a screw extending along the conveying channel, the casing has a case side bearing part rotatably supporting an upstream end part of the waste toner conveying body, an inside end face of the shutter has a shutter side bearing part rotatably supporting a downstream end part of the waste toner conveying body, the shutter moving mechanism includes:

an oblique groove obliquely formed in a circumference wall of the shutter so as to move the shutter between the opening position and closing position;

a protrusion formed in an outer circumference face of the casing so as to engage with the oblique groove;

a torsion coil spring applying a biasing force to the shutter so as to move the shutter to the closing position; and a lever protruded in a radial direction from a circumference face of the shutter and manipulated so as to move the shutter to the opening position against the biasing force of the torsion coil spring, the conveying body moving mechanism includes:

a drive gear driving and rotating the image carrier; and a following gear meshing with the drive gear and applying a thrust loading to the waste toner conveying body so as to move the shutter to the opening position when the drive gear is driven, the drive gear and following gear are composed of respective helical gears, in the inside end face of the shutter, a slope-like inclined part is formed to be inclined in the same direction and at the same angle as the oblique groove, and the inclined part is formed to come into contact with a downstream end face of the casing.

2. An image forming apparatus comprising:

a cleaning unit, wherein the cleaning unit includes:

a cleaning member eliminating a waste toner from an image forming face of an image carrier forming a toner image;

a waste toner conveying body conveying the waste toner in a conveying channel arranged in a casing supporting the cleaning member to a waste toner case;

a cylindrical shutter having an openable/closable ejecting port making the conveying channel and waste toner case communicate with each other and being able to contact with/separate from a seal preventing a leak of the waste toner from the ejecting port;

a shutter moving mechanism moving the shutter between an opening position and a closing position, wherein, when the shutter is rotated in one direction around an axis, and simultaneously, moved in an axial direction so as to make an outer end face of the shutter contact with the seal, the shutter is located at the opening position and the ejecting port is opened, while, when the shutter is rotated in another direction around the axis, and simultaneously, moved in the axial direction so as to make the outer end face of the shutter separate from the seal, the shutter is located at the closing position and the ejecting port is closed; and a conveying body moving mechanism interlocking with the movement of the shutter by the shutter moving mechanism to move the waste toner conveying body in an axial direction in the same direction as the shutter, wherein the waste toner conveying body is a screw extending along the conveying channel, the casing has a case side bearing part rotatably supporting an upstream end part of the waste toner conveying body, an inside end face of the shutter has a shutter side bearing part rotatably supporting a downstream end part of the waste toner conveying body, the shutter moving mechanism includes:

an oblique groove obliquely formed in a circumference wall of the shutter so as to move the shutter between the opening position and closing position;

a protrusion formed in an outer circumference face of the casing so as to engage with the oblique groove;

a torsion coil spring applying a biasing force to the shutter so as to move the shutter to the closing position; and a lever protruded in a radial direction from a circumference face of the shutter and manipulated so as to move the shutter to the opening position against the biasing force of the torsion coil spring, the conveying body moving mechanism includes:

a drive gear driving and rotating the image carrier; and a following gear meshing with the drive gear and applying a thrust loading to the waste toner conveying body so as to move the shutter to the opening position when the drive gear is driven, the drive gear and following gear are composed of respective helical gears, in the inside end face of the shutter, a slope-like inclined part is formed to be inclined in the same direction and at the same angle as the oblique groove, and the inclined part is formed to come into contact with a downstream end face of the casing.

* * * * *